United States Patent [19]

Confoey

[11] 4,373,851

[45] Feb. 15, 1983

[54] BULLDOZER AND BACKHOE LOCK DEVICE

[76] Inventor: Richard J. Confoey, 15846 Heiser Rd., Berlin Center, Ohio 44401

[21] Appl. No.: 195,376

[22] Filed: Oct. 9, 1980

[51] Int. Cl.[3] ..... B66F 9/20; F15B 15/26

[52] U.S. Cl. ..... 414/722; 92/23; 172/466; 172/831; 298/17 B

[58] Field of Search ..... 298/17 SG, 17 B, 38, 298/22 D, 17 S, 17 R, 22 R; 280/475; 248/351; 105/273; 92/23, 13.41; 188/67; 70/395, 396, 397, 398; 414/685, 687, 694, 722; 212/222; 172/466, 481, 674, 683, 831

[56] References Cited

U.S. PATENT DOCUMENTS

| | | | |
|---|---|---|---|
| 2,397,516 | 8/1944 | Stewart | 188/67 |
| 3,135,555 | 6/1964 | McCaskey | 298/22 |
| 3,157,435 | 12/1964 | Sherven | 298/17 |
| 3,662,653 | 5/1972 | Carlson et al. | 92/15 |
| 3,813,124 | 5/1974 | Roland | 298/17 B |
| 4,122,758 | 10/1978 | Bieringer et al. | 92/23 |

*Primary Examiner*—Robert J. Spar
*Assistant Examiner*—Janice Krizek
*Attorney, Agent, or Firm*—Harpman & Harpman

[57] ABSTRACT

A bulldozer and backhoe locking device for prevention of theft of heavy equipment having hydraulic pistons and cylinders by locking the blade or bucket against the ground by placement of an elongated sleeve pivoted together along one edge over the extended piston rod for engagement against the end of the piston and cylinder assembly and the boom of the backhoe or the blade of the bulldozer.

2 Claims, 6 Drawing Figures

BULLDOZER AND BACKHOE LOCK DEVICE

BACKGROUND OF THE INVENTION (1) Field of the Invention:

This invention relates to locking devices for use on equipment having hydraulic pistons and cylinders such as bulldozers and back hoes or the like.

(2) Description of the Prior Art:

Prior art devices have used a number of different safety supports for holding dump truck beds in up position. See for example U.S. Pat. Nos. 3,813,124, 3,157,435, and 3,135,555.

In U.S. Pat. No. 3,813,124 a safety prop for dump trucks is shown wherein an elongated tubular member is pivotally secured at one end between the truck bed and the truck frame thereby locking the truck bed in extended or up position.

In U.S. Pat. No. 3,157,435 a safety prop for dump trucks is shown having a spring loaded telescopically extensible tubular member positioned between the frame and the bottom of the dump bed.

In U.S. Pat. No. 3,135,555 a safety guard is disclosed wherein a tube is positioned around the rod of a hydraulic piston and cylinder preventing the dump truck bed from falling from the up position while the truck is being worked on.

In applicant's device a split cylindrical sleeve having an annular flange at one end and a pair of outwardly extending arms at the other is positioned over the extended rod portion of a hydraulic piston and cylinder assembly on the bottom of a back hoe attachment or like equipment to prevent the raising of the same from engagement with the ground thereby preventing movement of the tractor.

SUMMARY OF THE INVENTION

A bulldozer and backhoe locking device comprises a split elongated cylindrical sleeve pivoted together along its one edge and having an annular flange at one end and a pair of arms extending beyond the other end thereof. The locking device has apertured lugs to secure the same over the extended rod portion of a hydraulic piston and cylinder assembly on the blade or boom portion of the equipment thereby preventing the moving of the equipment.

DESCRIPTION OF THE PREFERRED EMBODIMENT

Figure 1:
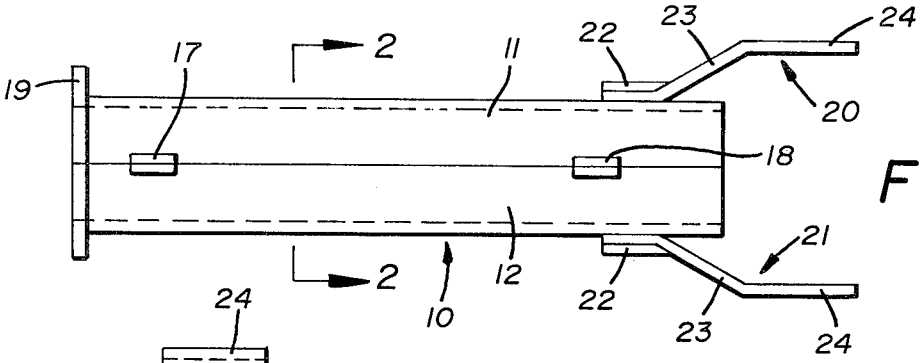
FIG. 1 is a top plan view of the lock device.
Figure 2:
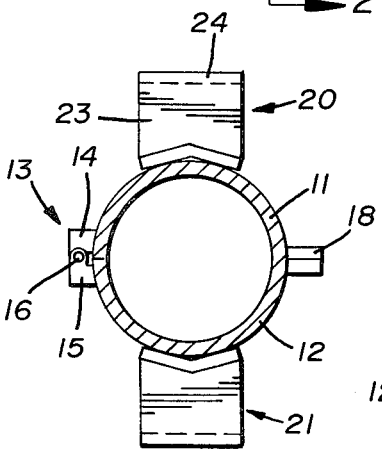
FIG. 2 is a cross sectional view on lines 2—2 of FIG. 1.
Figure 3:
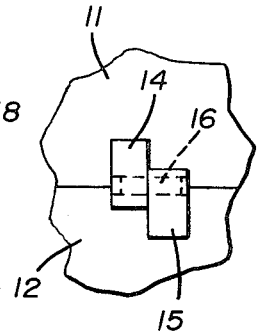
FIG. 3 is a detailed elevation on line 3—3 of FIG. 2.
Figure 6:
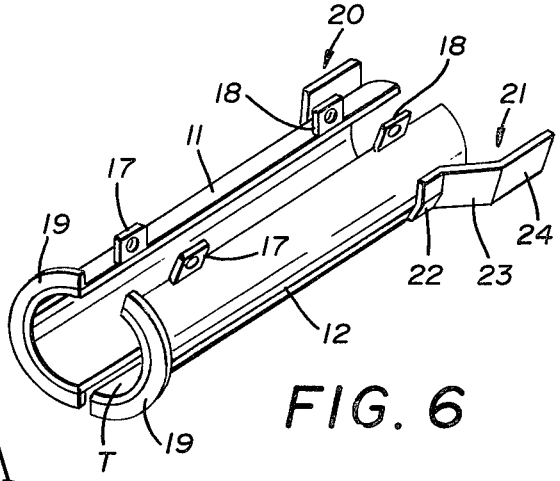
FIG. 6 is a perspective view of the lock device in partially opened position.

A bulldozer and backhoe locking device comprising a split cylindrical sleeve 10 as will be seen in FIGS. 1 and 6 of the drawings has equal half sections 11 and 12 with a pair of pivot hinges 13 therebetween, one of which is seen in FIGS. 2 and 3 of the drawings. Each of said hinges 13 comprises a pair of offset L-shaped extensions 14 and 15. A pin 16 is positioned through an aperture in said extension 15 and into a bore in said extension 14. The end of said pin 16 is secured in said aperture as by welding. Pairs of apertured lugs 17 and 18 extend from and are secured to each of said half sections 11 and 12 of said split cylindrical sleeve 10 opposite the hinges 13 as seen in FIGS. 1, 2 and 6 of the drawings.

The pairs of lugs 17 and 18 are apertured for placement of padlocks (not shown) therethrough.

Referring to FIGS. 1 and 6 of the drawings, two half circular parts 19 of an annular flange are formed on one end of said half sections 11 and 12 of said split cylindrical sleeve 10 while a pair of oppositely disposed outwardly extending arms 20 and 21 are secured adjacent the other end of said split cylindrical sleeve 10. Each of said arms 20 and 21 have a first portion 22 secured to said half sections 11 and 12 respectively as by welding and an intermediate portion 23 extends outwardly therefrom on an angle and an end portion 24 in parallel relation to said first portion extending beyond the end of said split cylindrical sleeve 10.

Figure 4:
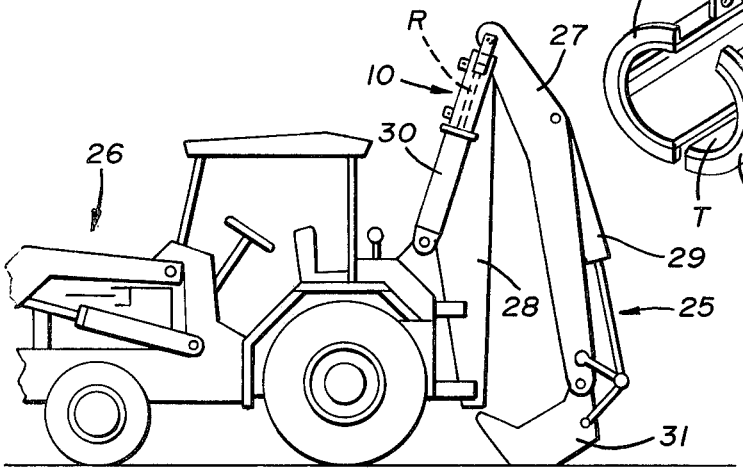
FIG. 4 is a side elevation of a back hoe equipped tractor and illustrating the device.

Referring now to FIG. 4 of the drawings, a backhoe attachment 25 is positioned on a tractor 26 having a pair of booms 27 and 28, hydraulic piston and cylinder assemblies 29 and 30 and a bucket 31 pivotally secured to one another.

Figure 5:
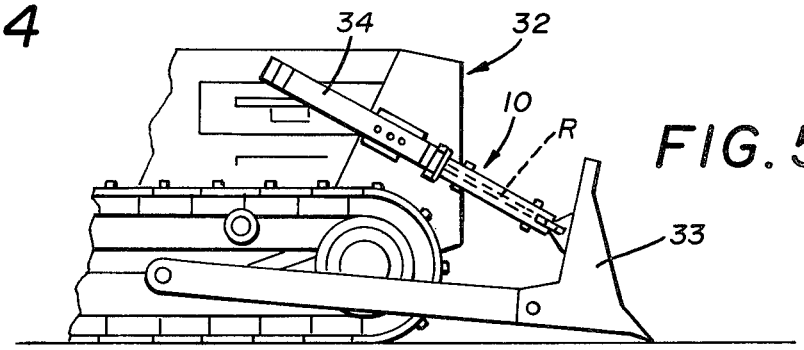
FIG. 5 is a side elevation of a portion of a bulldozer illustrating the device.

In FIG. 5 of the drawings, a portion of a bulldozer 32 is shown having a blade 33 pivotally secured to said bulldozer and a hydraulic piston and cylinder assembly 34 pivotally engaged thereon.

To use the locking device 10 in the backhoe 25, the hydraulic cylinder 30 is fully extended exposing the rod portion R. The split cylindrical sleeve 10 is opened, placed around the rod portion R and closed locking the rod R in extended position with the annular flange 19 in abutment with the end of the piston and cylinder assembly 30 providing distribution of force to the outer wall of the piston and cylinder assembly 30, and engagement of the opposite end of the split cylindrical sleeve with the boom 27. The arms 20 and 21 cover a pivot pin connecting the rod R with the boom 27 thereby preventing removal of the pin. The inner surface of the split cylindrical sleeve 10 is preferably coated with a slippery material such as TEFLON as indicated in FIG. 6 of the drawings by the letter T. (Tetrafluoroethene homopolymer).

It will thus be seen that with the locking device in place the boom 27 and the bucket 31 cannot be raised from engagement with the ground and thereby prevents the tractor 26 from being moved. To use the locking device on the bulldozer 32 as seen in FIG. 5 of the drawings, the hydraulic piston and cylinder assembly 34 is extended forcing the blade 33 against the ground. The split cylindrical sleeve 10 is opened and placed around the rod R of the hydraulic piston and cylinder assembly 34 to hold the rod R in extended position and the blade 33 in ground engaging position. With the blade in engagement with the ground, the bulldozer 32 cannot be moved thus effectively securing the equipment against unauthorized removal. Since the bulldozer and backhoe and like equipment have no effective locking means, the locking device 10 of the above described invention can greatly reduce the theft of such equipment without having to modify the equipment in any way.

Additionally, the locking device can be used on any manufacturer's equipment that has comparable hydraulic piston and cylinder assemblies. The only modification required of the device is to increase or decrease the overall length and/or diameter to suit the different hydraulic piston and cylinder assemblies to which the device is applied.

It will thus be seen that a new and useful locking device for bulldozers and backhoes or the like has been illustrated and described and it will occur to those skilled in the art that various changes and modifications may be made therein without departing from the spirit of the invention.

Having thus described my invention what I claim is:

1. A locking device for use on a piston rod of a hydraulic piston and cylinder assembly of a bulldozer, tractor, backhoe, and the like arranged to hold an implement thereof in an extended position and comprising a cylindrical sleeve of a length to fit said piston rod in its extended position, said cylindrical sleeve consisting of a pair of sleeve halves having oppositely disposed longitudinally extending meeting edges, half circular portions of an annular flange on one end of said sleeve halves of a diameter greater than the diameter of the cylinder of said piston and cylinder assembly, means hinging said sleeve halves to one another and secondary means for locking said sleeve halves to one another, oppositely disposed outwardly extending solid arms on the other end of said cylindrical sleeve arranged to cover pivoted portions including the pivot of said bulldozer, tractor, backhoe and the like.

2. The locking device of claim 1 wherein said oppositely disposed outwardly extending arms are offset in relation to said sleeve halves.

* * * * *